United States Patent [19]

Trevits et al.

[11] Patent Number: 4,474,409

[45] Date of Patent: Oct. 2, 1984

[54] METHOD OF ENHANCING THE REMOVAL OF METHANE GAS AND ASSOCIATED FLUIDS FROM MINE BOREHOLES

[75] Inventors: Michael A. Trevits; Roger L. King; Gerald L. Finfinger, all of Pittsburgh, Pa.

[73] Assignee: The United States of America as represented by the Secretary of the Interior, Washington, D.C.

[21] Appl. No.: 416,192

[22] Filed: Sep. 9, 1982

[51] Int. Cl.[3] ..... E21B 43/26; E21B 33/124; E21B 33/127; E21F 7/00

[52] U.S. Cl. ..... 299/16; 166/308; 299/12

[58] Field of Search ..... 299/16, 12, 21; 166/386, 387, 187, 191, 50, 308; 405/263, 267

[56] References Cited

U.S. PATENT DOCUMENTS

| | | | |
|---|---|---|---|
| 2,211,243 | 8/1940 | Meyer | 299/16 |
| 2,751,016 | 6/1956 | Watzlavick | 166/187 X |
| 2,927,638 | 3/1960 | Hall, Sr. | 166/308 X |
| 3,384,416 | 5/1968 | Ruehl et al. | 299/16 |
| 3,650,564 | 3/1972 | Williamson | 299/12 X |
| 4,065,927 | 1/1978 | Davis | 405/267 |
| 4,072,015 | 2/1978 | Morrell et al. | 405/289 |
| 4,321,967 | 3/1982 | Koppe et al. | 299/12 X |
| 4,394,051 | 7/1983 | Oudenhoven | 299/16 |

FOREIGN PATENT DOCUMENTS

| | | | |
|---|---|---|---|
| 2640136 | 3/1978 | Fed. Rep. of Germany | 299/16 |

*Primary Examiner*—Stephen J. Novosad

*Attorney, Agent, or Firm*—Thomas Zack; Eugene J. Pawlikowski

[57] ABSTRACT

The method disclosed herein relates to the removal of unwanted gases and associated fluids in underground mining operations by utilizing mine boreholes. After the mine borehole has been drilled its desired distance from the mine face, an inflatable packer assembly is inserted therein and placed to the end remote from the mine face. This assembly is made up of at least two spaced inflatable packers wherein the spacer between the packers in conjunction with the borehole defines an isolation zone. Fluid conduit members, suitably supported at the mine face, extend into the borehole and act as supply lines from the two separate fluid sources for the packer assembly and isolation zone. A fracturing fluid under high pressure is supplied to the isolation zone and an inflatable fluid is supplied to the at least two packers to rigidly mount them in the borehole. After a fracture is induced in the zone, an additional amount of fracturing fluid is injected thereinto to extend the fracture. A propping medium made of particulate matter may be added to the fracturing fluid to retain the fractures open. Thereafter, the pressure of the fracturing fluid is released, the packers deflated, the gas and associated fluids exhausted, and the packer assembly moved to another location in the borehole nearer the mine face. At this new location, the procedure is repeated again and, it is contemplated, at several additional successive borehole locations along the borehole wherein each is progressively nearer than the preceding towards the mine face.

6 Claims, 3 Drawing Figures

METHOD OF ENHANCING THE REMOVAL OF METHANE GAS AND ASSOCIATED FLUIDS FROM MINE BOREHOLES

BACKGROUND OF THE INVENTION

The method herein disclosed is used to remove methane gas from mine boreholes.

DESCRIPTION OF THE PRIOR ART

Boreholes, usually horizontal, have been drilled in mine faces to release methane gas from the earth towards the mine working area. This gas was then exhausted from the mine via a gas pipeline to thereby minimize the possibility of an explosion as mining operations take place. The borehole, with such a method, is drilled not strictly in a horizontal plane and perpendicular to the directional permeability of the coal bed. In this way, it was thought, the most methane gas could be liberated from the coal bearing strata. What we have done is develop a better and more effective method which enhances the flow of methane by fracturing the coal in isolated successive zones or sections along the length of the borehole.

Hydraulic fracturing of the earth has been used in boreholes to block the flow of methane gas into coal mines. U.S. Pat. Nos. 4,009,578 (D. S. Choi) and 4,065,927 (J. G. Davis II) disclose this type of borehole fracturing. In each case, it will be noted, there is a single hydraulic fracture of the borehole which extends from notches at the end of the borehole. Neither employs aligned inflatable plugs with its method nor do they employ a method which uses successive isolation of zones to be fractured.

Although sections of mine boreholes have been isolated into successive aligned sections by inflatable blatters, as in U.S. Pat. No. 4,072,015 to R. J. Morrell et al, the purpose of isolating these sections was to supply a pressurized fluid therebetween to provide support for the boreholes. Its purpose was also to control the collapse of the borehole. It was not used to fracture the borehole in a preferred fracture direction, as here, or to release a large amount of methane gas. To our knowledge, the present invention is the first to use isolated borehole sections and then employ successive hydraulic fracturing of the earth surrounding the borehole to release methane gas and associated fluids from the borehole. These fractures can be created and extended along the entire length of the borehole to increase the flow of gases to be exhausted therefrom.

SUMMARY OF THE INVENTION

The method of our invention consists of several steps. Initially a generally horizontal borehole is drilled into the mine face the desired distance. Next, an elongated support and fluid conduit is inserted into the borehole and fixed in place. Following this, a packer assembly is inserted into the borehole and placed near the most remote position of the borehole from its mine face. The packer assembly is made of at least two aligned separated inflatable packers connected by a fluid spacer with openings. These spacer conduit openings act to supply a fracturing fluid to the borehole space or isolation zone between the packers. The packers themselves are supplied with pressurized fluid from another source to thereby expand and isolate a section of the borehole. The fluid pressure of the fracturing fluid in the isolated zone is increased until the rock is fractured. After the fracture in the zone is induced, more fracturing fluid is injected thereinto to extend the fracture. Next, the pressure in the fracturing fluid is released in a controlled flowback manner. Finally, the inflated packers are deflated, the unwanted gas and fluid are exhausted, and the packers moved to a new position in the borehole nearer the mine opening. Thereafter, at successive borehole locations, along the length of the borehole the inflation, fracturing, fluid release, and deflation steps are repeated again and again.

DESCRIPTION OF THE PREFERRED EMBODIMENT

The United States Bureau of Mines (BOM) has done extensive research relating to the control of methane gas. Its Report of Investigations (RI) 7640 entitled "Methane and Dust Control by Water Infusion," published in 1972, details, e.g., on pages 7–14, how aligned multiple inflatable packers have been used to infusion water in the back of the borehole. A more recent BOM publication—RI 7849, published in 1974, entitled "Methane and Dust Controls for Longwalls: Pocahontas No. 3 Coalbed, Grundy, VA."—details background data on the effects of water infusion on methane and respirable and total dust. The contents of both of these RIs are incorporated by reference herein as background material.

Figure 1:
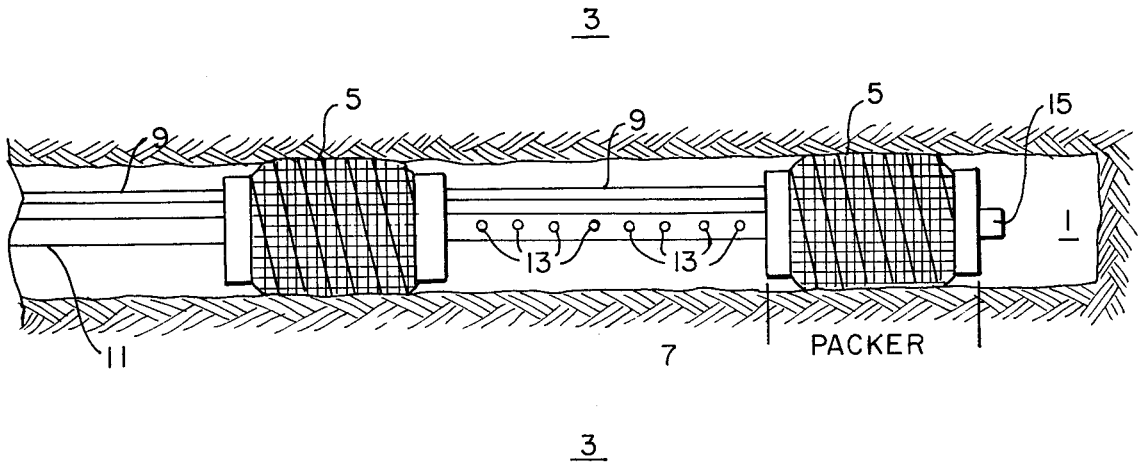
FIG. 1 schematically illustrate how the plug assembly of the preferred embodiment would appear, in a cross-sectional view of the borehole, after the necessary set up steps have occurred.

The preferred embodiment shown in FIG. 1 illustrates the packer assembly and associated conduits in situ in a mine borehole located near its end remote from the mine face. Actually, the borehole 1 is depicted in a cross-sectional view with the earth 3 surrounding it on three sides. The right side represents the end of the borehole most remote from the mine working area and the left side extends towards and to the opening with the mine working area (not shown). Within the borehole there are shown two identical inflatable packers 5 horizontally aligned with each other and spaced apart to form a volume therebetween with the borehole which defines an isolation region or zone 7. Fluids are supplied from the mine working area by way of two separate elongated fluid conduit sources as indicated by the direction of the arrows. Each of these conduits extend through the first packer nearest the working area to the second packer and thereby serve as the spacers therebetween. The upper smaller diameter conduit 9 has openings (not shown) which communicate with the first packer to allow an inflatable fluid to enter and fill the packer. Fluid conduit 9 terminates with an opened end in the second (right most) packer to provide for its inflation. The lower larger diameter conduit 11 supplies pressurized fracturing fluid to the isolation region 7. Perforations 13 within conduit 11 allow the pressurized fluid to enter and fill the isolation region. At the end of the second packer, most remote from the working area, a plug 15 serves to block the movement of fluid out of the free end of conduit 11 into the end of the borehole.

Figure 2:
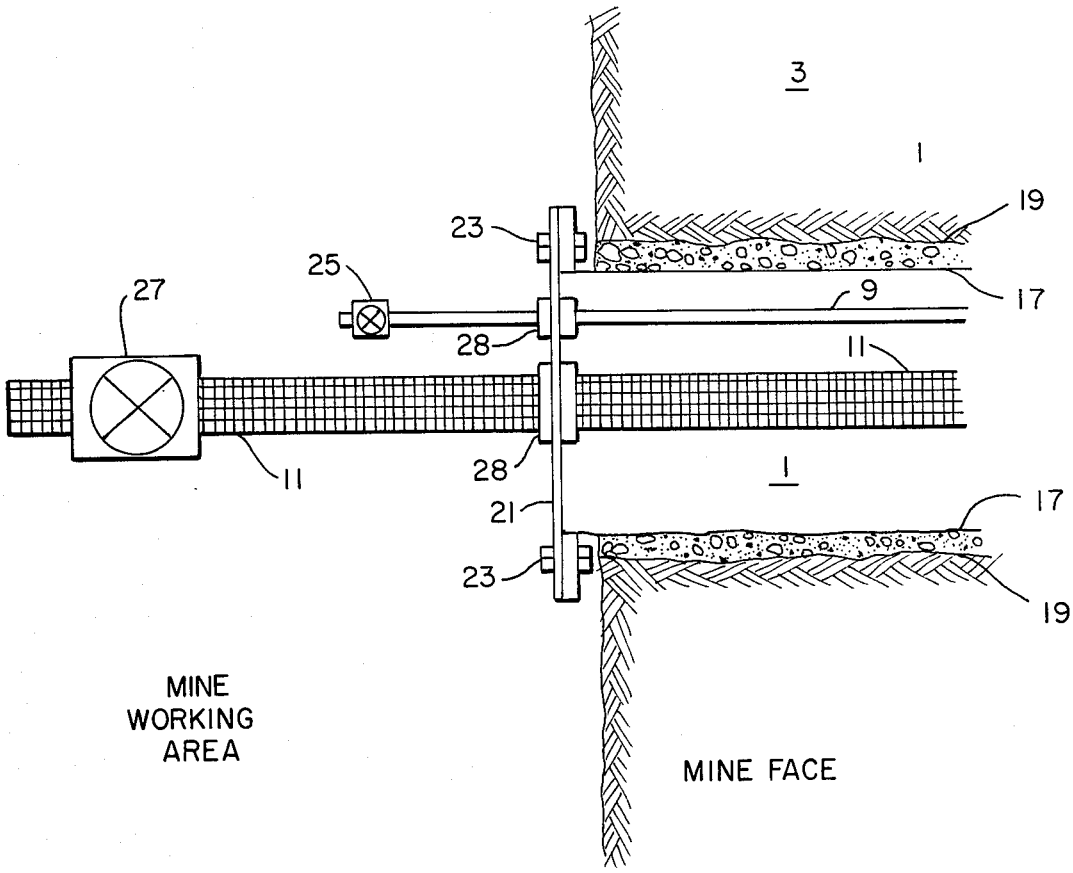
FIG. 2 is an enlarged view of the preferred embodiment of the equipment used to control the introduction of fluids into the borehole as viewed from the mine face end.

FIG. 2 illustrates how the FIG. 1 connection would appear to the left at its junction with the mine working face at the borehole entrance or beginning. The same members have been used in all figures to designate the same features. After a 5 inch diameter borehole, for example, has been drilled to a desired horizontal depth, in one case approximately 50 feet, a section of seamless high quality pipe 17, 4.5 inches in outside diameter, termed standpipe, is inserted into the borehole and cemented (19) in place. This standpipe and cemented casing extend about 49 feet into the borehole and function to provide a rigid support to secure the string of high pressure tubing 11 and conduit 9 to be inserted into the borehole thereafter. Next the borehole is extended into the coalbed using a smaller diameter drill bit (approximately 3 inches) assembly for distances from 2,500 to 3,000 ft. A circular closure plate 21 with an outflange receives a plurality of nuts and bolts 23 which closes the end of the standpipe except for two openings for the previously mentioned conduits 9 and 11. The valves 25 and 27 serve to control the entrance/exit of fluids into and out of the conduits 9 and 11, respectively. Also, packing assemblies 28 prevent leakage of gas and water in the working area which may have collected during the fracturing operation which is to follow.

Figure 3:
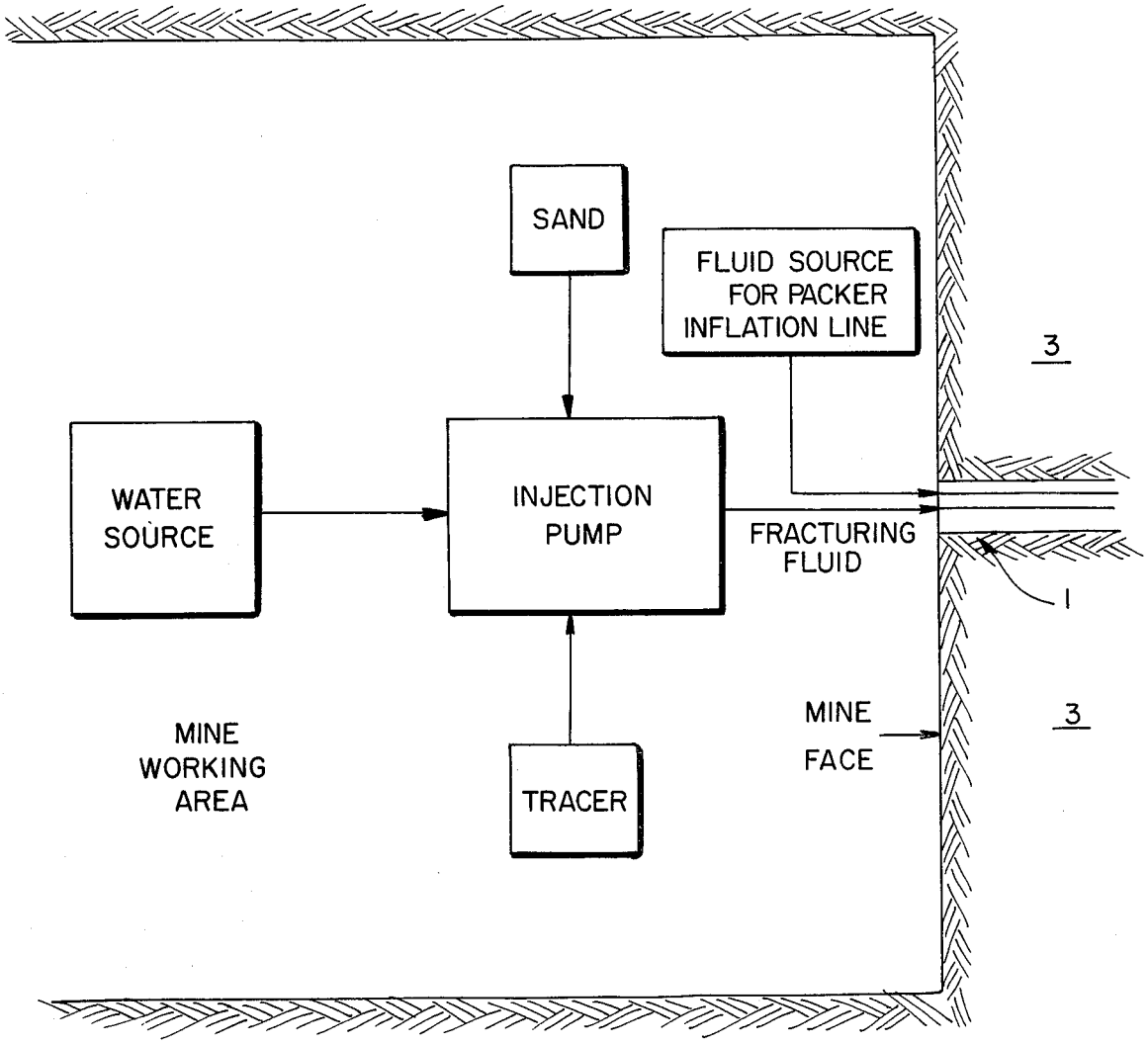
FIG. 3 is a block diagram of the preferred embodiment indicating how fluids can be injected into the packer assembly and fracturing region.

After the FIG. 1 and FIG. 2 equipment have been mounted into the borehole, a souce of pressurized fracturing fluid (see FIG. 3) is connected to conduit 11 to the left of its valve. An injection high pressure pump receives water, and a liquid tracer which combination is then injected as the fracturing fluid in a controlled manner into the conduit. Before the fracturing fluid enters the borehole, both packers were inflated by fluids from an air, water, or other source (FIG. 3) to expand, and engage, and firmly block the borehole and fix the packer assembly in place therein as shown in FIG. 1. Thereafter the fracturing fluids pass through the first packer (FIG. 1) and exits at the isolation region 7 to fill it. Pressure is increased on this fluid in the region until fracturing of the rock or extension of a natural fracture is initiated. A specified volume of fluid is then injected to extend the fracture. Sand, sieved particles, or other particulate matter may be added to the fracturing fluid (FIG. 3) at the pump to serve as a propping medium as the induced pressure is released. Once the specified volume of fracturing fluid is injected into the isolation region or zone, the addition of the particulate propping medium is terminated and a volume of fracturing fluid equal to the volume of the conduits and packer assembly is pumped out to clean the inhole equipment and flush the isolation zone. This flushing technique removes any debris that may have collected in the isolation region 7 and permits safe movement of the equipment once the induced pressure has been removed. Pumping is then terminated and the fracturing fluid is permitted to flow back under controlled conditions towards the mine working area or mine face where fluid holding facilities receive it. When this happens, the fracture fluid is recovered while the sand, sieved particles, or other particulate matter remains suspended in the induced fracture(s). Once induced pressure has dissipated, the inflatable packers are deflated and moved to a new location in the borehole closer to the mine face. At the new location, the method of inflating the packers to define an isolation zone; fracturing the borehole in the isolation zone; and deflating the packers is again repeated. This method is then repeated again and again successively along the length of the borehole as the created isolation zones are moved nearer and nearer to the mine face. In the 2,500–3,000 foot borehole example given, the regions isolated would be about every 50 feet, beginning in the borehole terminus and moving towards the mine face. As the method is practiced at each zone, the sand or other particulate matter may be added to the fracturing fluid to act as a propping medium to keep the induced fractures open to allow more methane gas and associated fluid to escape and be exhausted from the mine. Once fracturing of all zones has been completed, methane gas and associated fluid flow from the coalbed into the borehole by means of pressure differentials.

Although this method has been described with respect to the releasing of methane gas from a coal mine, it may be applied to other types of mining operations where gas accumulations present problems to the miners or mining operation. For example, the method could be used to remove hazardous gases in underground domal salt or oil shale fractures. Some modification would be necessary in a domal salt fracture, brine or a salt saturated fluid would be used for the fracturing fluid because nonsaturated fluids would erode the borehole in the isolated region and cause the fractures to grow past the packers and into the borehole, and in a shale mine, the fracturing fluid used would be compatible with the rock to preserve the permeability thereof.

The actual parameters employed to practice our method depend on the environment in which practiced and the practical considerations involved. For example, if fracturing is to take place in a coalbed, the pressure ranges of the fracturing fluids would be from 500 to 2,500 psig. In all cases, the fracturing pressure would be no less than the least principle stress in the coalbed or rock being formed. As for the inflating fluids for the packers involved, either air, water, gelled fluid or any other fluid which is safe in an underground environment could be used. The preferred fluid is water because of its ease of obtainability underground and its relative incompressibility coupled with its low fluid viscosity. Isolation zone 7 can vary in length and the distance between the two packers would normally range from about 1 to 10 feet. Also, the length of the packers is variable and would normally be 5 to 15 feet. Whatever the length chosen, the purpose of the packers is the same, i.e., to create an effective seal in the borehole and prevent induced fractures from initiating within the isolation zone and then growing past the packers and reentering the borehole area outside of the packers.

Other uses of the method disclosed herein are also possible. The borehole isolation zone could be used as a means for determining the variation of permeability along the length of the borehole. This is done by injecting the fluid (which was the fracturing fluid) at pressures well below that which is required to induce fractures. The results of the injection test—pressure fluid volume data—may then be used as input into standard permeability formulas. Another method is to permit the infusion of water at multiple locations in horizontal boreholes drilled as infusion boreholes as compared to the standard method which permits infusion into the borehole from the terminus area only. This alternate use would use the same method without any proppant material and with an injection fluid rate substantially lowered. After the borehole is isolated—beginning at its rear portion—the fluid is injected at a rate of approximately 5 to 10 gallons per minute. After this is done, the fluid is shut in the borehole and the pressure thereon within the isolation zone or region is allowed to naturally decrease or stabilize. One this pressure stabilization occurs, the tubing is opened and the water flowing to the mine face is collected in holding tanks. The packers are then deflated and moved to a new location within the borehole. This process is repeated until all locations within the borehole have been treated. With this method, excessive amounts of water may be infused into the rock interval in advance of mining operations.

Other advantages and uses of our invention different from those disclosed may be apparent to those persons skilled in the art. However, none of these should be used to change the scope and spirit of our invention which is to be limited only by the claims which follows:

We claim:

1. A method of removing hazardous gas and associated fluids from an underground mine comprising the steps of:

(a) drilling a borehole from a mine into the earth in a generally horizontal direction;

(b) mounting a fluid conduit support structure in the mine borehole extending thereinto from the mine borehole entrance;

(c) mounting an inflatable packer assembly in said borehole at or near its end remote from the mine borehole entrance, said assembly having at least two separate inflatable packers spaced apart longitudinally to define a volume making up an isolation zone therebetween within said borehole;

(d) connecting fluid conduit means to both said at least two inflatable packers and said defined isolation zone, said conduit means extending therefrom to said mine borehole entrance;

(e) supplying pressurized fluid to said conduit means to inflate said at least two inflatable packers;

(f) supplying a fracturing fluid under sufficient pressure via said conduit means to said isolation zone whereby the material forming the borehole thereat is induced to fracture, said induced fracture being extended by the injection of more pressurized fluid into said zone;

(g) decreasing the pressure of said fracturing fluid at the isolation zone; and (h) deflating the packer assembly and moving it to a new location in the same borehole nearer the mine borehole entrance.

2. The method of claim 1 wherein after step (h) takes place steps (e) to (h) are repeated in that order.

3. The method of claim 1 wherein in step (f) the induced fracture may be extended by adding a propping medium to the fracturing fluid as it is injected.

4. The method of claim 1 wherein the unwanted gas to be removed is methane from a coal mine which is exhausted from the fracture after step (h).

5. The method of claim 1 wherein after step (h) takes place step (c) is repeated nearer to the mine face, and thereafter steps (d) to (h) are repeated in that order.

6. The method of claim 1 wherein step (a) is accomplished by drilling two different diameter aligned boreholes from the mine face with the larger diameter section being nearer the mine working face.

* * * * *